United States Patent [19]

Zanatta

[11] Patent Number: 4,800,658

[45] Date of Patent: Jan. 31, 1989

[54] ADJUSTABLE REAR CLOSING DEVICE FOR SKI BOOTS

[75] Inventor: Ruggero Zanatta, Nervesa della Battaglia, Italy

[73] Assignee: Calzatruificio Tecnica Spa, Treviso, Italy

[21] Appl. No.: 71,250

[22] Filed: Jul. 9, 1987

[30] Foreign Application Priority Data

Jul. 14, 1986 [IT] Italy ..... 22509/86[U]

[51] Int. Cl.[4] ..... A43C 11/00; A43B 5/04

[52] U.S. Cl. ..... 36/50; 36/105; 36/121

[58] Field of Search ..... 36/117–121, 36/105, 50; 24/68 SK, 69 SK, 70 SK, 71 SK

[56] References Cited

U.S. PATENT DOCUMENTS

| | | | |
|---|---|---|---|
| 4,265,034 | 5/1981 | Salomon | 36/121 |
| 4,519,149 | 5/1985 | Pozzobon | 36/121 |
| 4,575,958 | 3/1986 | Arieh et al. | 36/121 |

FOREIGN PATENT DOCUMENTS

| | | | |
|---|---|---|---|
| 0149445 | 7/1985 | European Pat. Off. | 36/121 |
| 2557776 | 7/1985 | France | 36/117 |
| 57-86301 | 5/1982 | Japan | 36/121 |
| 549970 | 6/1974 | Switzerland | 36/121 |

*Primary Examiner*—James Kee Chi

*Attorney, Agent, or Firm*—Armstrong, Nikaido, Marmelstein & Kubovcik

[57] ABSTRACT

Rear closing device for rear-entry ski-boots, comprising a lever arrangement easily and readily operated between the opened and clamped positions and permitting adjusting of clamping position of boot leg in relation to shell and hence of inclination of boot leg.

5 Claims, 1 Drawing Sheet

ADJUSTABLE REAR CLOSING DEVICE FOR SKI BOOTS

Figure 1:
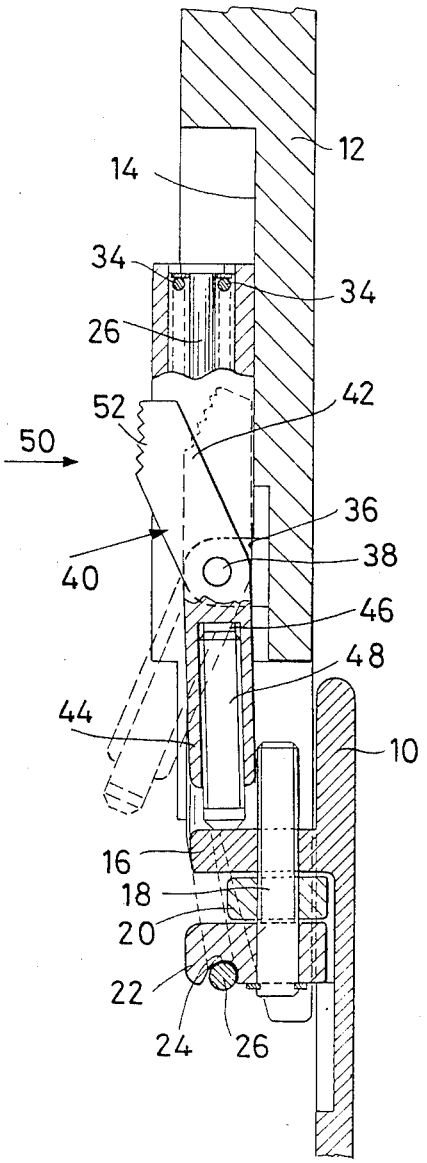

The present invention relates to the rear closure of ski boots of the so-called rear entry type.

Ski boots comprise normally a rigid external shell and an inner liner of soft material designed to receive the foot while making use of the boot comfortable. To the shell is also fixed a boot leg, usually in such a manner as to permit variation of the inclination of the legs in relation to the ski and hence of the skier's position.

The boot leg is normally formed of two parts capable of being opened out, the closing of which encloses the skier's leg in an adjustable and known manner.

If the opening part of the boot leg is the front part introduction of the foot is rather difficult and in addition the inner liner must be oversized in relation to the foot, especially at the instep, so that the specific function of the rigid shell is partially cancelled out.

In recent years in order to facilitate shoeing of the foot and secure an improvement of the waterproofness, snowproofness and aerodynamics of the boot, boots have been produced of the so-called rear-entry type. In this case it is the rear part of the boot leg which opens out and permits easier introduction of the foot in the liner and then in the boot.

In boots of this type there is usually provided a clamping closure of the rear part of the boot leg, i.e. the part opening out, to the boot shell, a closure which however involves certain problems.

In the first place if the closing device is very stout and the closure strongly tightened difficulties arise in operation, especially if fast, allowing for the fact that said operation is performed on the ski grounds and hence at low temperatures and sometimes with snow and ice covering the closing lever.

Another problem lies in the fact that with this type of closing device inclination of the boot leg is fixed in a certain position in relation to the boot shell and in particular the position of the rear support of the skier's leg is fixed.

The main object of the present invention is to solve such problems and drawbacks with benefit.

A more specific object is to produce a rear closing device for rear-entry boots which would ensure easy clamping and especially unclamping.

Another specific object of the present invention is to produce a rear closing device for rear-entry boots which would permit adjustment of the clamping position of the boot leg in relation to the shell and hence of the inclination of the boot leg.

This and other objects are achieved with an adjustable rear closing device for rear-entry ski boots comprising a hook integral with the boot leg and engaging under the action of elastic means a hooking member integral with the shell of the boot, characterized in that lever means are provided consisting of a bracket lever hinged in an intermediate position to said boot leg in such a manner as to turn in an essentially vertical plane constituting the plane of symmetry of the ski boot said bracket lever comprising a first arm designed to be operated for unclamping the closing device by pressure tending to draw it near the adjacent surface of said leg the second arm of said bracket lever being pierced axially to form the seat of a threaded locking-, support- and adjusting pin, the end of said pin protruding from the free end of said second arm in such a manner as to rest against the horizontal projection protruding from said shell when the closing device is locked.

As will appear more clearly from the following detailed description of the preferred embodiment of the device in accordance with the invention given with reference to the annexed drawings, with said device the problems and drawbacks briefly outlined above are eliminated with benefit.

In the drawings

Figure 2:
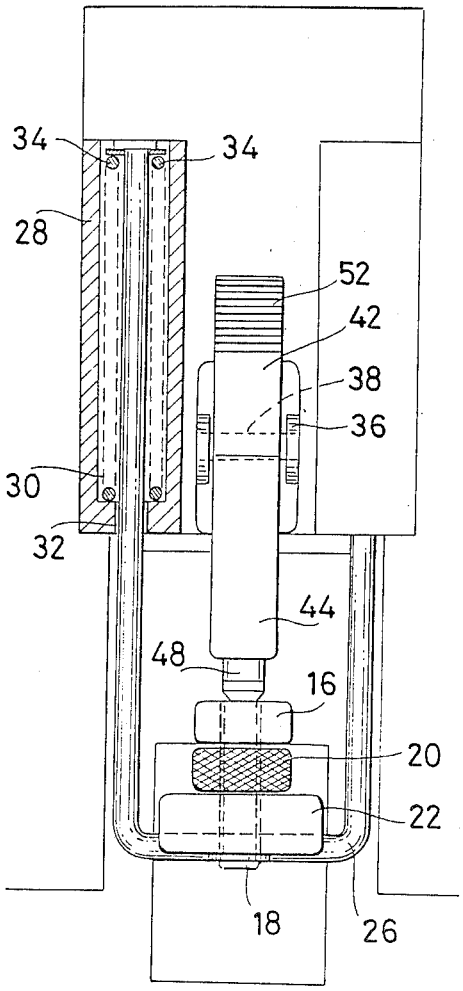

FIG. 1 is a vertical section of the locking device in accordance with the invention, and FIG. 2 is a front view of the device of FIG. 1.

In the annexed drawings for drawing clarity and simplification there are shown only parts of the ski boot shell and of the rear part of the boot leg, indicated with reference numbers 10 and 12 respectively.

In the boot leg 12 as may be seen in FIG. 1 there is formed a recess 14 in which is housed the operating lever of the device in accordance with the invention.

With the shell 10 is formed in a single piece a projection 16 to which is fixed by means of a screw 18 and a bolt 20, a hook bracket 22 having a seat or recess 24 for an essentially U-shaped hook 26.

The two arms of the U are housed in two respective blocks 28 mounted symmetrically in the recess 14 and having an inner cavity 30 communicating with the exterior through a hole 32 through which passes the respective side of the U of the hook 26.

As can be clearly seen in FIG. 2 the upper end of each side of the U formed by the hook 26 is widened and presses against one end of two opposing springs 34 whose opposite side reacts against the opposite inner surface of the cavity 30. The action of the the spring 34 is mainly to oppose elastic resistance each time the skier tends to incline the boot leg forward, resistance which increases in proportion to the degree of inclination.

To the boot leg 12 inside the recess 14 there are fixed two brackets 36 which support a pin 38 acting as the fulcrum of an operating bracket lever, indicated as a whole by reference number 40, and comprising two arms 42 and 44 respectively.

As can be clearly seen in FIG. 1 in the lever 40 the two arms are inclined at a small angle from each other such that the arm 42 is shifted in relation to the bottom of the recess 14 without however protruding much from the plane described by the outer edges of the recess 14, i.e. from the outer surface of the leg 12.

The other arm 44 of the lever 40 has a blind axial hole 46 in which there is a seat for a supporting and adjusting pin 48, engagement between the pin 48 and the hole 46 being effected by threading.

The pin 48 protrudes in relation to the free end of the arm 44 of the lever 40 and in the clamped position of the device rests against the upper surface of the projection 16.

At the pin 38 there is provided a torsion spring (not shown and of conventional type) which stresses the lever 40 toward the position shown in solid lines in FIG. 1 then pushing the arm 44 toward the projection 16.

From FIG. 1 it can be clearly seen that the more the pin 48 protrudes from the hole 46 the more the boot leg 12 will be forced to rotate around the pivot point and the more it will be inclined forward in relation to the shell 10.

In this manner, as can be easily understood accurate and easy adjustment of the inclination of the boot leg best suited to the person using the boot is possible.

In addition the firm resting of the pin 48 against the projection 16 brings about greater resistance of the boot leg to rearward inclination. Concerning operation of the device in accordance with the invention, in FIG. 1 it can be seen clearly that by pressing the arm of the lever 42 in the direction of the arrow 50 (exactly on the knurled or corrugated part 52 of the arm 42) the lever rotates around the fulcrum 38 and the end of the pin 48 is brought to the position illustrated in broken lines in FIG. 1 wherein it is completely disengaged from the projection 16.

At this point the hook 26 disengages from the recess 24 of the bracket 22 and the rear closing device is completely unclamped and the boot leg 12 is completely released and free to be opened out for introduction or withdrawal of the foot (as required).

Clamping takes place automatically by bringing the hook 26 back into engagement with the recess 24. The pin 48 is brought back into engagement with the projection 16 thanks to the end bevel thereof as well as to the action of the opposing spring acting on the pin 38.

From the above description it appears clear that the clamping device in accordance with the present invention meets the objects thereof with benefit.

It is understood however that conceptually equivalent modifications and variants are possible and foreseeable without exceeding the scope of said invention.

I claim:

1. Adjustable rear closing device for a rear-entry boot having a shell and a boot leg with a rear portion, said device comprising:

a hook connected to the rear portion of the boot leg;

a hooking member connected to the boot shell, said hook being resiliently engageable with said hooking member;

operating lever means for facilitating positional adjustment of the rear portion of the boot leg in relation to the shell comprising a bracket lever pivotally mounted in an intermediate position of the boot leg for pivotal movement about an essentially vertical plane constituting a plane of symmetry of the boot, said bracket lever comprising a first arm for unclamping the device upon being urged towards the boot leg, a second arm having an axially extending threaded aperture in a free end thereof, and a threaded adjusting pin receivable in said threaded aperture, said pin having an end adjustably protruding from said free end of said second arm; and a horizontal projection extending from said shell, said end of said pin being abuttingly engageable with said horizontal projection when said device is clamped, whereby the relative position of the boot leg in relation to the shell is adjustable according to the extent by which said pin protrudes from said free end of said second arm.

2. A closing device according to claim 1, wherein said bracket lever is pivotally mounted on a horizontally extending pin supported by two brackets protruding from a housing recess formed in a rear surface of said boot leg, said second arm being resiliently urged towards an adjacent surface of the boot leg.

3. A closing device according to claim 1, wherein said end of said adjusting pin is tapered.

4. A closing device according to claim 1, wherein said hook is U-shaped, the arms of said hook being housed at their free ends in blocks integral with said boot leg, said blocks having inner cavities housing spring means for opposing movement of said free ends as a result of forward inclination of the boot leg in relation to the shell.

5. A closing device according to claim 4, wherein said free end of each arm has a widened portion, and said spring means comprise compression springs acting against each said widened portion.

* * * * *